US006571723B1

(12) United States Patent
Bech et al.

(10) Patent No.: US 6,571,723 B1
(45) Date of Patent: Jun. 3, 2003

(54) SYSTEM FOR MOORING A TANKER NEAR AN OFFSHORE FLOATING UNIT

(75) Inventors: Arild Bech, Arendal (NO); Kare G. Breivik, Tau (NO)

(73) Assignees: Navion ASA (NO); Advanced Production and Loading AS (NO)

( * ) Notice: Subject to any disclaimer, the term of this patent is extended or adjusted under 35 U.S.C. 154(b) by 0 days.

(21) Appl. No.: 10/009,360

(22) PCT Filed: May 11, 2000

(86) PCT No.: PCT/NO00/00156

§ 371 (c)(1),
(2), (4) Date: Dec. 3, 2001

(87) PCT Pub. No.: WO01/00482

PCT Pub. Date: Jan. 4, 2001

(30) Foreign Application Priority Data

Jun. 30, 1999 (NO) ..... 993264

(51) Int. Cl.[7] ..... B63B 21/00
(52) U.S. Cl. ..... 114/230.2; 441/3
(58) Field of Search ..... 114/230.1, 230.2, 114/219; 441/3, 4

(56) References Cited

U.S. PATENT DOCUMENTS 2,919,671 A * 1/1960 Knapp et al. ..... 114/230.2
3,950,805 A * 4/1976 Murphy ..... 405/203
5,159,891 A * 11/1992 Lohr et al. ..... 114/230.2
5,501,625 A * 3/1996 Belinsky ..... 114/230.2

FOREIGN PATENT DOCUMENTS

WO WO 97299943 * 8/1997 ..... 114/230.1

* cited by examiner

*Primary Examiner*—Stephen Avila
(74) *Attorney, Agent, or Firm*—Clifford W. Browning; Woodard, Emhardt, Naughton, Moriarty & McNett LLP

(57) ABSTRACT

A system for anchoring of a tanker near an offshore production unit (1) which is anchored by means of a number of anchor lines (2, 14) and associated anchors, and from which a tanker (3) in use of the system is supplied with oil or gas. The system comprises a first and a second pair of bottom-anchored buoys (13 resp. 15) located before or behind the production unit (1), as seen in the prevailing weather direction (W), and at a chosen distance from the production unit (1). The buoys (13) of the first pair are located closer to the production unit (1) than the buoys (15) of the second pair, and the buoys (13 resp. 15) of each pair has a chosen mutual distance transversely to said weather direction (W), so that a tanker (3) may be moored in the region between the buoys (13, 15) with the fore-and-aft direction essentially coinciding with said weather direction (W). The system further comprises a collision barrier (22) extending between the buoys (13) of the first buoy pair and being connected thereto, to prevent a collision between the tanker (3) and the production unit (1).

12 Claims, 7 Drawing Sheets

SYSTEM FOR MOORING A TANKER NEAR AN OFFSHORE FLOATING UNIT

The invention relates to a system for mooring a tanker near an offshore production unit which is anchored by means of a number of anchor lines and associated anchors, and from which a tanker in use of the system is supplied with oil or gas via a transfer means, the tanker normally being moored behind the production unit, as seen in the prevailing weather direction.

In connection with offshore production of hydrocarbon products (oil and gas) in regions with calm weather conditions (for example the coast of Western Africa and Brazil), it is common to use floating production vessels with conventional spread mooring. Such an arrangement is shown in FIG. 1 of the drawings, wherein a production vessel 1 is anchored by means of a spread mooring comprising a plurality of anchor lines 2 extending between the production vessel 1 and respective non-illustrated anchors.

In the following description there is referred to FPSOs (Floating Production Storage Offloading) which is the branch designation of production vessels of the relevant type. If the unit is also equipped for drilling, the branch designation is FDPSO (Floating Drilling Production Storage Offloading).

In connection with the topical loading operations, the production vessel (FPSO) 1 will be oriented with the bow against the prevailing weather/current direction which is represented by the arrow W in FIG. 1.

In the known system according to FIG. 1 the transport of the crude oil produced on board the FPSO 1 takes place by means of tankers 3 which typically moor at the stern of the FPSO (tandem mooring) and receive the load via a floating hose 4 which is connected to the midship manifold 5 of the tanker.

One or more smaller tender vessels 6 normally will assist during mooring and disconnection of the tanker 3. During the loading operation proper one or more tender vessels 6 possibly will also be able to be used to keep the tanker 3 at a desired position in relation to the FPSO 1.

Experience has shown that the tanker 3, which during a tandem loading operation typically is situated only about 50–100 m from the stern of the FPSO 1, may have the ill-luck to touch/collide with this vessel. Among other things, this may happen when the current direction changes 180° in the course of a short time. The consequences of such incidences may be very serious.

The oil industry therefore has also chosen other mooring solutions for the tanker 3, where the solutions afford a greater security, but simultaneously are more expensive.

A typical such solution is shown in FIG. 2 which shows a "spread mooring" anchored FPSO having a so-called Calm buoy 7 for loading/export to a tanker 3. The solution implies that the tanker 3 moors to the Calm buoy 7 which is located at a "safe" distance L1 (typically 2–4 km) from the FPSO 1. The tanker 3, which then normally only uses a mooring hawser 8 at the bow, will be able to turn around the Calm buoy 7 under the influence of varying environmental forces, the buoy being provided with a swivel 9 allowing said turning.

However, such a system implies large extra costs which, among other things, are due to the fact that risers and a pipe line 10 must be installed between the FPSO vessel 1 and the Calm buoy 7. Particularly the costs will be high if the water depth is great.

The object of the invention is to provide a mooring system for the stated purpose affording a safe mooring of the tanker near an offshore production unit, and where the introductorily mentioned problems are taken care of in a simple and cost-efficient manner.

For achieving the above-mentioned object there is provided a system of the introductorily stated type which is characterised in that it comprises a first and a second pair of bottom-anchored buoys located before or behind the production unit, as seen in the prevailing weather direction W, and at a chosen distance from the production unit, the buoys of the first pair being located closer to the production unit than the buoys of the second pair, the distance between the two buoy pairs being greater than the length of the tankers to be moored, and the buoys of each pair having a chosen mutual distance transversely to said weather direction, the buoys being arranged for connection of respective mooring lines for mooring of a tanker in the region between the buoys with the fore-and-aft direction essentially coinciding with said weather direction, and that it further comprises a collision barrier extending between the buoys of the first buoy pair and being connected thereto, to prevent a collision between the tanker and the production unit.

The above stated system can be used both in connection with a "spreadly moored" FPSO as described above, and other fixedly anchored platformms constituting offshore production units. The system makes use of only known technology and maritime operational procedures.

It is also an object of the invention to provide a mooring system affording a safe mooring of a tanker near a floating unit, such as a "spar" platform, where the introductorily mentioned problems are taken care of in a simple and cost-efficient manner.

For achieving the above-mentioned object there is provided a system for mooring a tanker near a floating unit which is anchored by means of a number of anchor lines and associated anchors, and from which a tanker in use of the system is supplied with oil via a transfer means, the tanker being moored behind the floating unit as seen in the prevailing weather direction, which system is characterized in that it comprises a first pair of bottom-anchored buoys located behind the floating unit, as seen in the prevailing weather direction, and at a chosen distance from the floating unit, the buoys having a chosen mutual distance transversely to the weather direction and being arranged for connection of a respective end of a pair of mooring lines for mooring of a tanker by connecting the other ends of the mooring lines to the bow of the tanker, and that it further comprises a collision barrier extending between the buoys and being connected thereto, to prevent a collision between the tanker and the floating unit.

The invention will be further described below in connection with exemplary embodiments with reference to the drawings, wherein FIGS. 1 and 2 show examples of prior art of the aforementioned type;

In the drawings, similar or corresponding units or elements are partly designated by the same reference numerals in the different figures.

Figure 1:
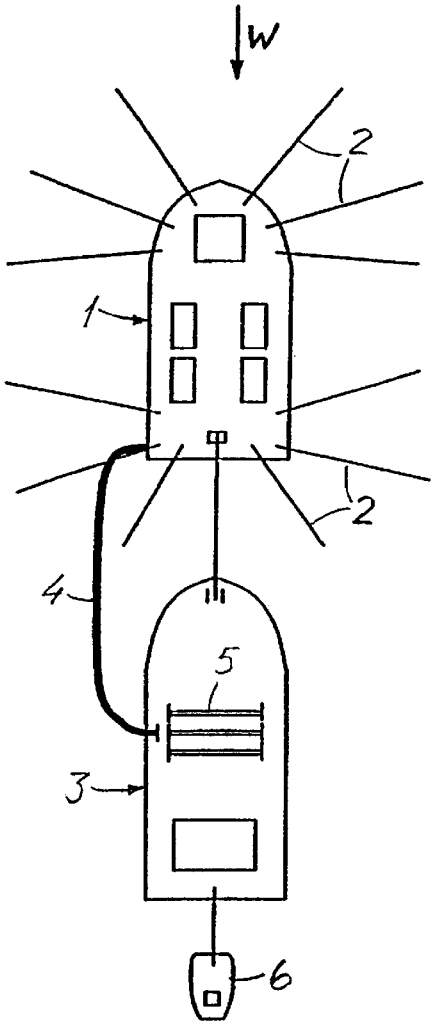
FIG. 1 (Prior Art)
Figure 2:
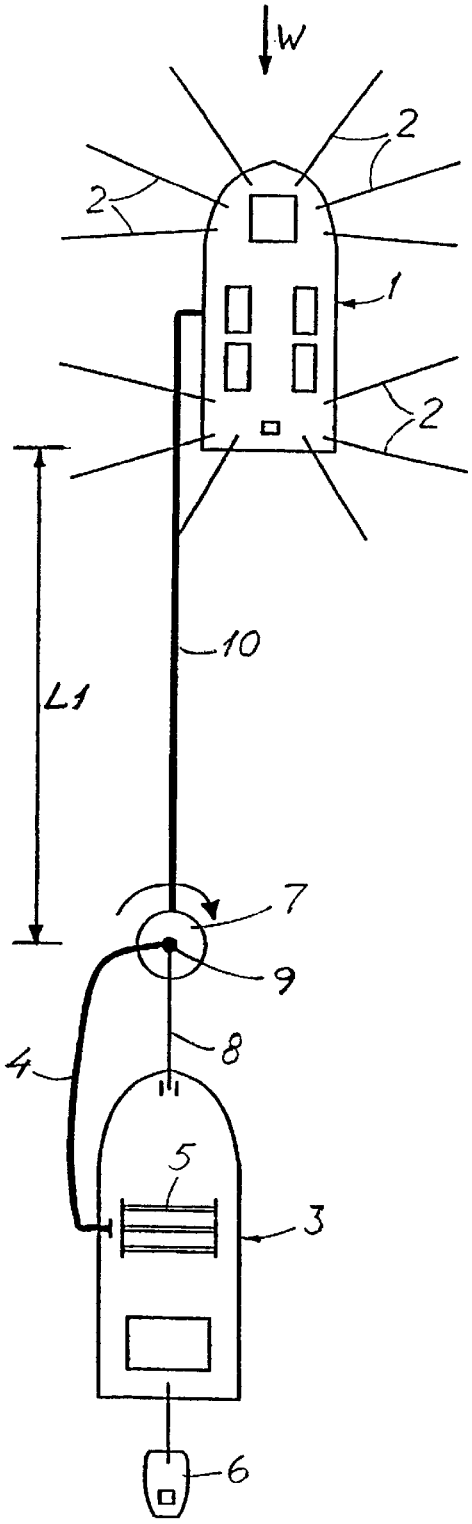
FIG. 2 (Prior Art)
Figure 3:
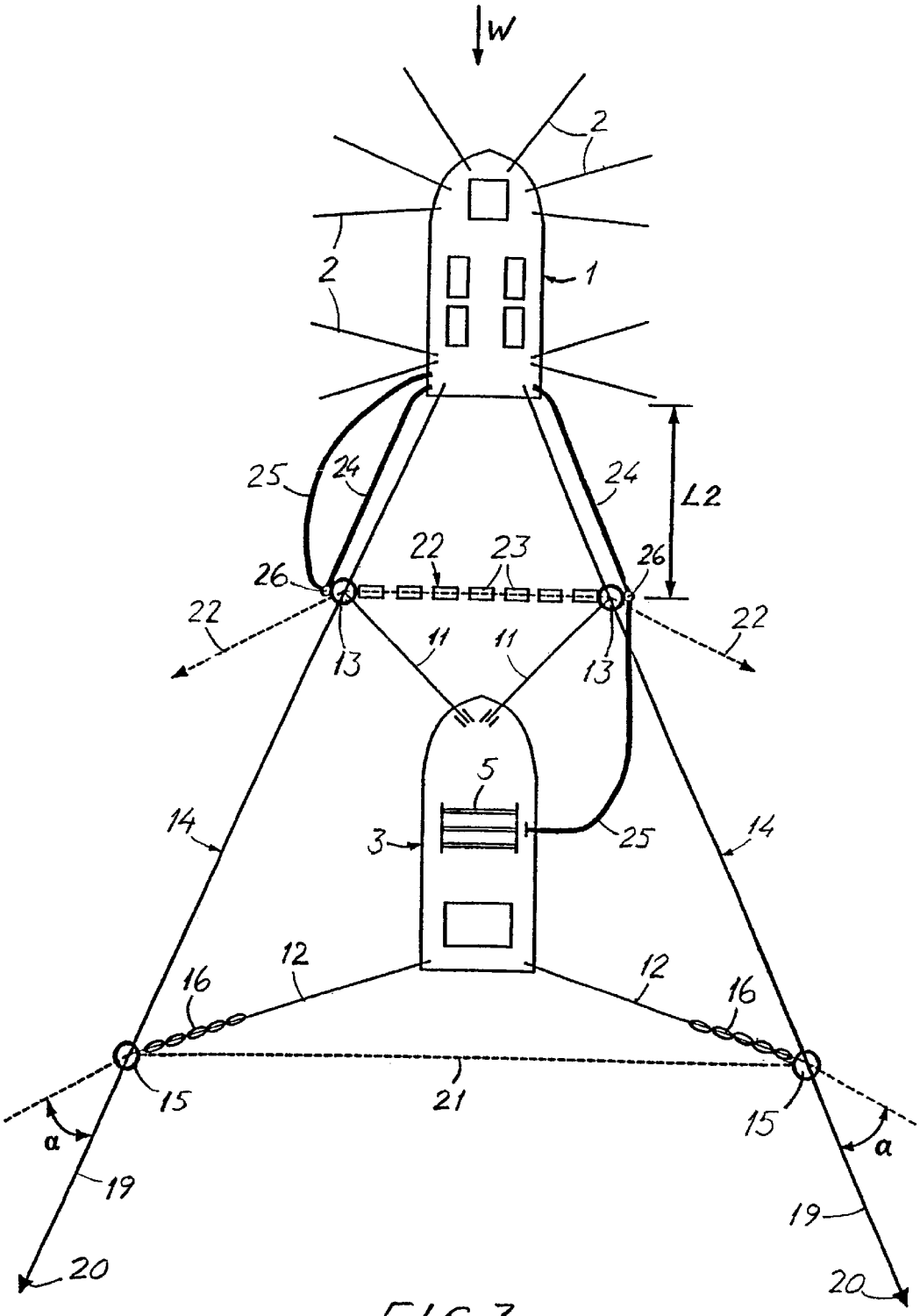
FIG. 3 shows a plan view of a system according to the invention, wherein the system is arranged behind the relevant production unit, as seen in the prevailing weather direction.

As appears from FIG. 3, the system shown therein is arranged in such a manner that the tanker 3 normally is anchored by a pair of mooring lines 11 forward in the bow region, and a pair of mooring lines 12 astern. All mooring lines to which there is referred in the description, possibly may be duplicated, triplicated, etc.

The mooring lines or hawsers 11 forward are attached to a separate independent, bottom-anchored buoy 13, which buoys in the illustrated embodiment are anchored to the same mooring lines 14 as used astern by the FPSO vessel 1. The buoys 13 preferably will float on the surface.

In a corresponding manner, the mooring lines or hawsers 12 of the tanker 3 astern are attached to bottom-anchored buoyancy buoys 15 which, like the buoys 13, also may go in as integrated components in the anchoring system of the FPSO, such as in the illustrated embodiment. The buoys 15 may be so-called "spring" buoys, and the mooring lines 12 are shown to comprise a chain portion 16 near the buoys 15.

Figure 4:
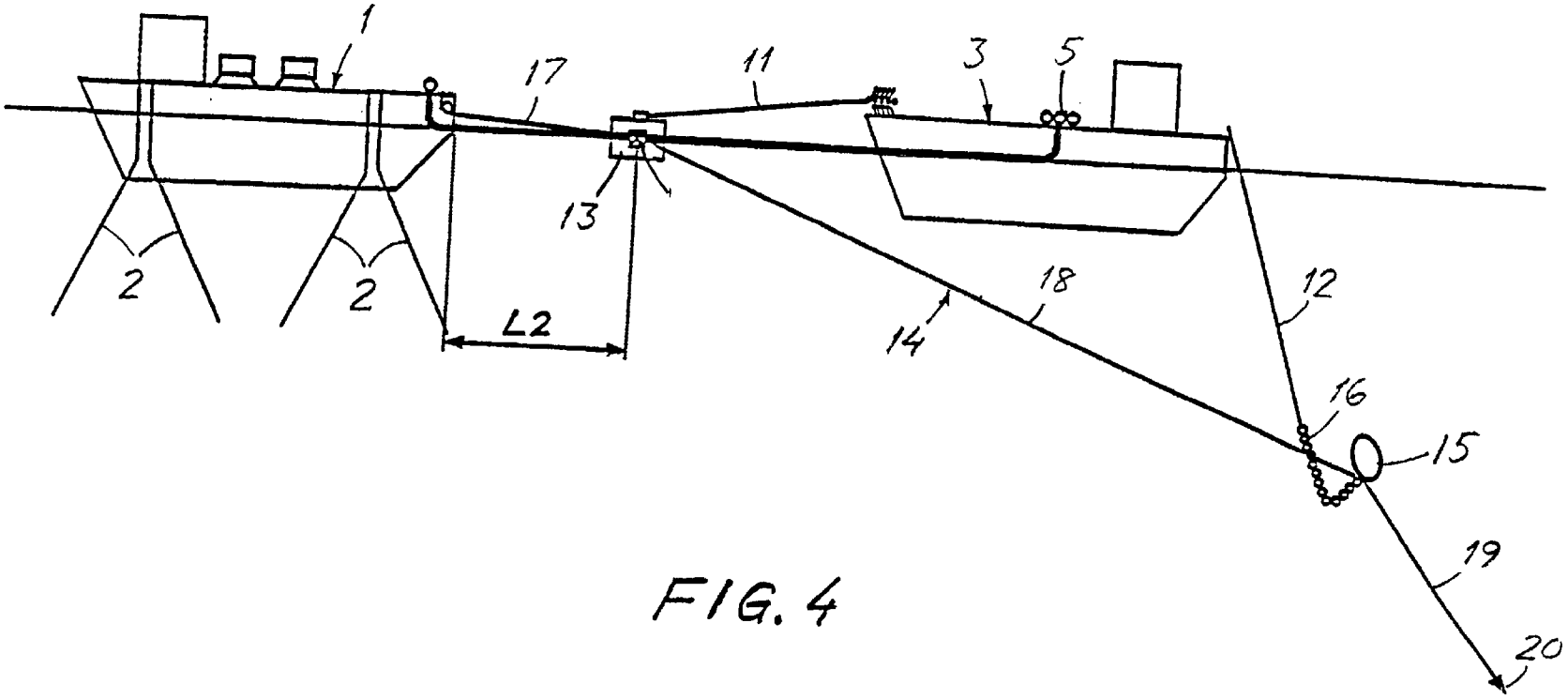
FIG. 4 shows a side view of the system in FIG. 3.

In the illustrated embodiment, in which the buoy pairs 13 and 15 are fixed to the anchor lines 14 of the FPSO, these anchor lines in FIG. 4 are shown to comprise an upper segment 17 in front of the buoys 13, a middle segment 18 between the buoys, and a lower segment 19 aft of the buoys 15. As suggested, the anchor lines at its lower end are connected to an anchoring point 20.

It is to be remarked that anchoring lines and other equipment aft of the buoys 13 normally will be submerged under water, so that the tanker 3 can moor safely without coming into conflict with the equipment being at or near the surface.

Between the buoys 13 there is arranged a collision barrier 22 which may suitably consist of several interconnected, floating fenders 23, and which typically will be placed at a distance L2=100–150 m. aft of the FPSO, at a hight resulting in that the bow of the tanker 3 does not pass over the fenders during a possible forward movement thereof.

The collision barrier thereby ensures that the tanker 3 is effectively stopped if the tanker in case of a fault operation or an accident should move towards the stem of the FPSO 1.

The shock energy in the illustrated embodiment is transferred via the anchoring lines 14 to the anchoring points 20.

It is to be remarked here that supplementary anchoring lines may be arranged to ensure that there is a required strength and stability in the line system. It may for example be suitable to install such a supplementary supporting line 21 under water between the buoyancy buoys 15. Further, the buoys 13 possibly may connected to respective supporting lines 22 extending outwards from the buoys and being connected to respective anchors (not shown).

Figure 5:
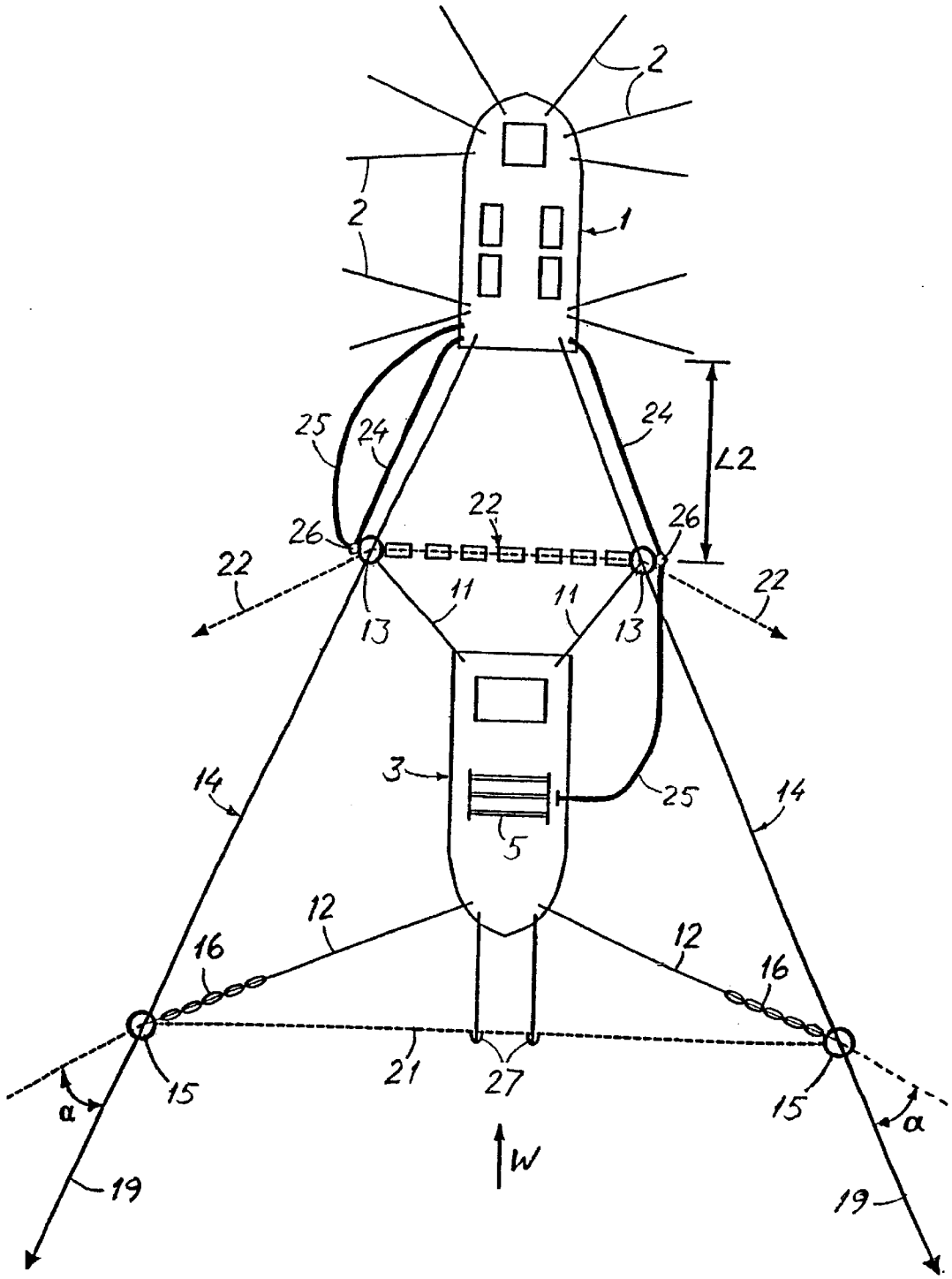
FIG. 5 shows a plan view of a system corresponding to that shown in FIG. 3, but where this is arranged in front of the production unit as seen in the prevailing weather direction.

In those cases where there is installed a supporting line 21, it may also be of interest to arrange the lower segments 19 of the anchoring lines 14 so that they diverge additionally outwards in relation to the rest of the lines 14, to increase the stability of the anchoring system. In FIGS. 3 and 5, this additional divergence is indicated by an angle $\alpha$.

The transfer of oil takes place via one or two independent hose systems connected to the midship manifold 6 of the tanker 3 on the port side and starboard side, respectively. Each hose system comprises first and second floating hoses 24 and 25, respectively, which are interconnected through a swivel 26 fixed to a respective one of the forward buoys 13. The first hose 24 is permanently coupled between the FPSO 1 and the swivel 26, and the second hose 25 may be pivoted by means of the swivel 26 between a storage position in which it extends between the swivel 26 and the FPSO, and an operative position in which it extends between the swivel and the midship manifold 5 of the tanker 3. Thus, the hose 25 may be secured in said storage position when the tanker 3 is not moored.

The solution shown in FIG. 3 presupposes a horizontal rotation of the swivel element 26. However, other solutions wherein the swivel rotation takes place in the vertical plane, may also be used. In FIG. 3, the port side hose system is shown in the stored position.

By arranging two separate loading hoses (on the starboard and port side) there is obtained a higher loading rate and an extra security against operational interruptions.

The tanker 3 normally will moor with the bow towards the FPSO 1, as shown in FIG. 3. However, if dictated by the prevailing weather/current conditions, the tanker 3 may, as an alternative, approach obliquely from forward and moor so that the bow faces away from the FPSO 1. This gives a greater flexibility in the mooring phase, and will be able to give an increased arrival regularity under changing weather/current conditions.

FIG. 5 shows the tanker 3 with the bow facing away from the FPSO 1. With the illustrated four-line mooring, the tanker 3 will be able to remain safely situated in this position during the whole loading operation, even if the prevailing weather/current direction (indicated with the arrow W) should change.

When the tanker 3 moors with the bow facing outwards or away from the production unit 1, it may be of interest to use the separate anchors 27 of the ship as an additional mooring. The tanker then approaches to a position in front of the supporting line 21 between the buoys 15, where the anchors are submerged to a depth somewhat greater than the depth of the supporting line. When the tanker 3 thereafter moves aftward, the anchors 27 will grip around the supporting line 21, so that an initial anchoring of the bow is achieved until the remaining mooring lines 11 and 12 are attached.

Figure 6:
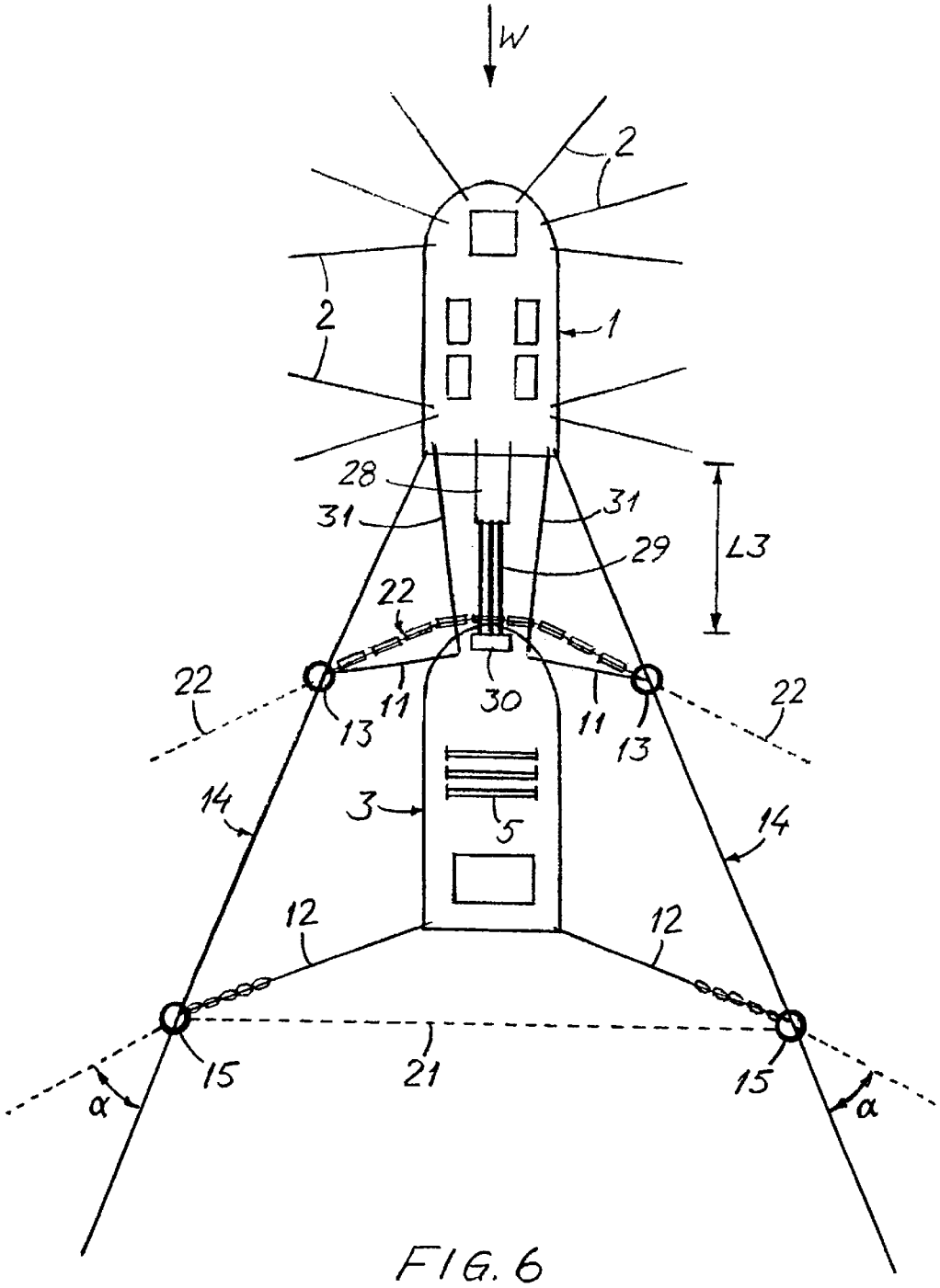
FIG. 6 shows a plan view of a system according to the invention, where this is adapted for mooring and loading of an LNG ship.

FIG. 6 shows a special application of the system according to the invention, wherein this is adapted for mooring and loading of a LNG ship 3 which is moored to the stern of the FPSO 1 (tandem mooring). The FPSO unit 1 here is provided with a loading boom 28, and LNG loading hoses 29 extend between the loading boom and a bow manifold 30 on the LNG ship 3.

The LNG ship must be situated as close to the FPSO unit as possible. This is necessary because the LNG loading hoses 29 should be as short as possible. A typical acceptable distance is L3=30–60 meters.

For such operations it is simultaneously of great importance to ensure that the bow position of the LNG ship does not change in an uncontrolled manner in relation to the FPSO unit.

As shown, the bow of the LNG ship rests against the collision barrier 22 which prevents physically that the units 1 and 3 shall be able to touch each other. Further, the bow position of the ship is secured by a pair of mooring hawsers 31 to the FPSO unit 1, and by the afore-mentioned mooring lines or mooring hawsers 11 to the forward buoys 13. At its rearward end, the LNG ship 3 is moored by means of the two mooring lines 12, as in the alternatives described before.

With the illustrated arrangement, the operative and security requirements to LNG load transfer will be taken care of in a satisfactory manner.

Figure 7:
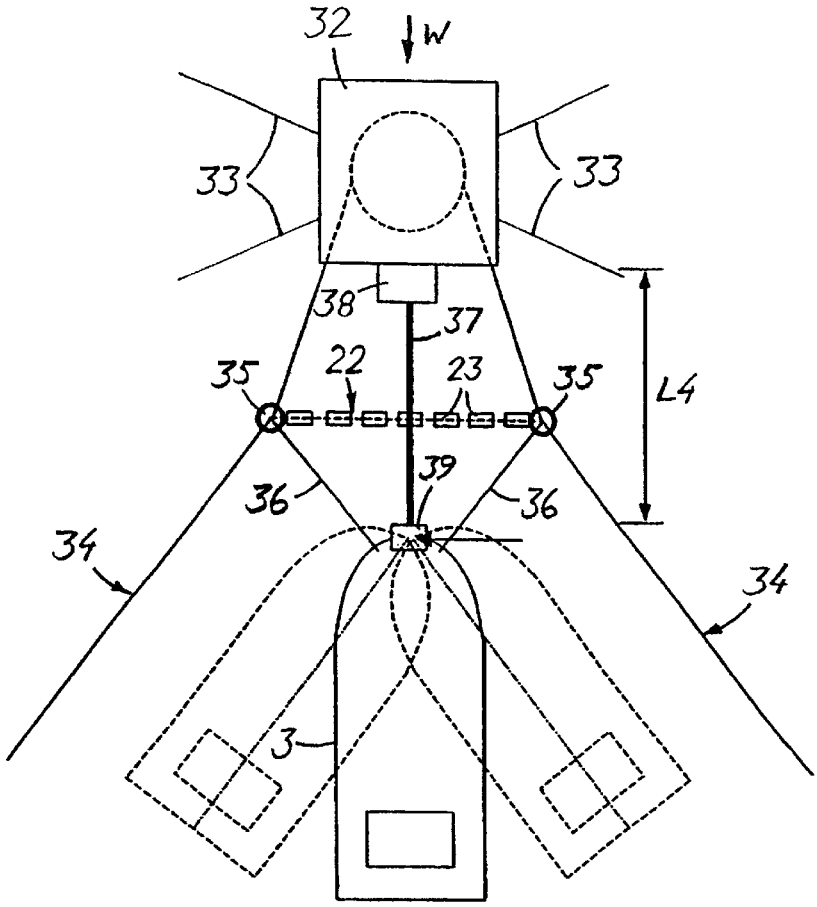
FIG. 7 shows a plan view of an additional system according to the invention, where the system is arranged behind a "spar" platform, as seen in the prevailing weather direction.
Figure 8:
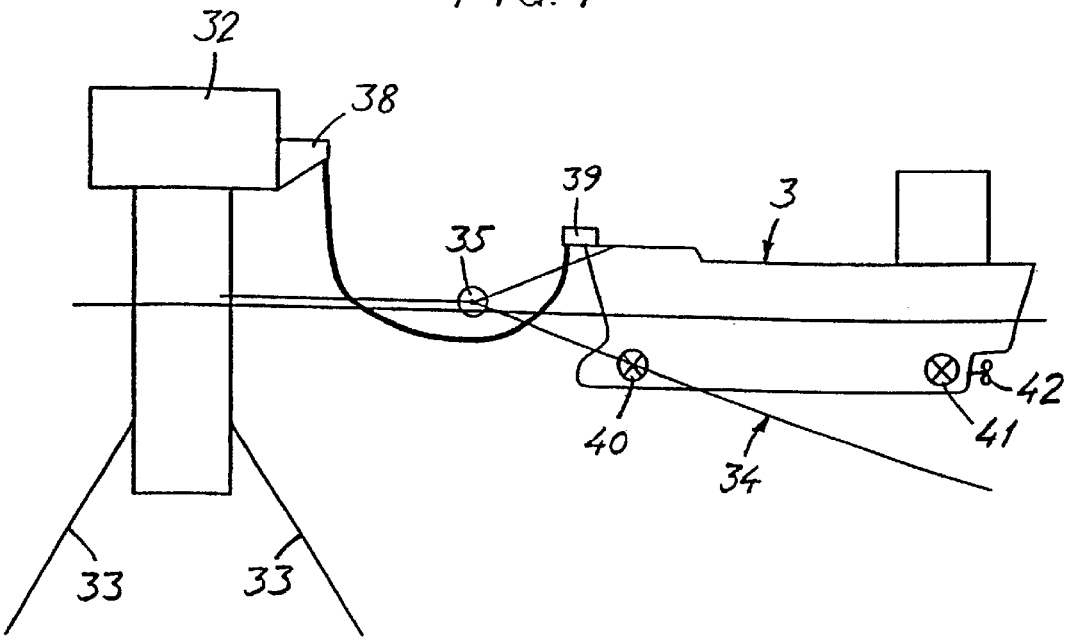
FIG. 8 shows a side view of the system in FIG. 7.
Figure 9:
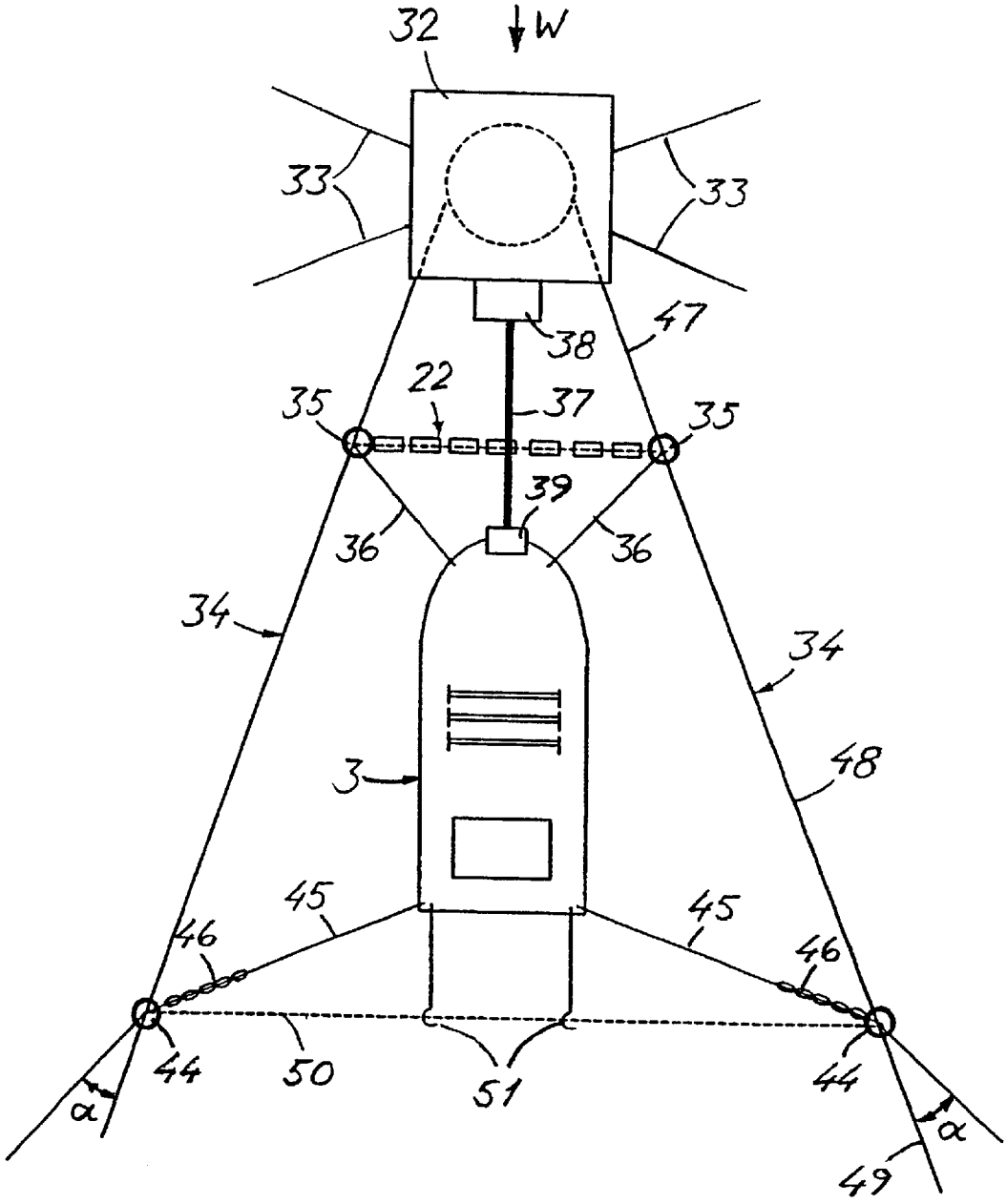
FIG. 9 shows a plan view of a modified embodiment of the system in FIG. 7.

An additional variant of the system according to the invention is shown in FIGS. 7–9. This variant is particularly intended for use when loading from a so-called "spar" platform, in regions where there are good and stable weather conditions allowing ship arrivals mainly from one direction.

In FIGS. 7 and 8 there is shown a floating unit 32 in the form of a spar platform which is anchored by means of a plurality of anchor lines 33 and 34 and associated anchors (not shown); and where a tanker 3 is moored behind the platform 32, as seen in the prevailing weather direction W. In the illustrated embodiment, the mooring system comprises a first pair of bottom-anchored buoys 35 located behind the platform 32 at a chosen distance therefrom, the buoys having a chosen mutual distance transversely to the weather direction W and being arranged for connection of a respective end of a pair of mooring hawsers or mooring lines 36 for mooring of a tanker 3, a first end of the mooring lines being connected to a respective one of the buoys 35, whereas the other end is connected to the bow of the tanker 3.

Oil is transferred from the platform 32 to the tanker 3 via a loading hose 37 extending between a loading boom 38 on the platform and the bow manifold 39 of the tanker. The distance L4 between the platform and the bow of the tanker typically may be 100–150 meters.

The relevant tanker 3 normally will be equipped with forward and rearward thrusters 40 and 41, and with a reversible propeller 42.

Between the buoys 35 there is arranged a collision barrier 22 in a corresponding manner as described above, so that the barrier consequently is situated between the platform 32 and the tanker 3 and ensures that a collision between the platform and the ship is not possible. If considered to be necessary, there may possibly be arranged more than one barrier.

As appears, the buoys 35 are fixed to a respective one of a pair of the anchor lines 34 diverging in a direction away for the platform 32, so that the moored tanker is situated between these anchor lines.

In the system according to FIGS. 7 and 8 the tanker is moored only at a bow mooring, the ship "hanging" in this mooring under the influence of wind and waves in the prevailing weather direction W.

In FIG. 9 there is shown a modified embodiment of the system, wherein the tanker 3 is also moored by means of a stem mooring. Thus, in this embodiment the system comprises also a second pair of bottom-anchored buoys 44 which are situated at a chosen distance behind the first pair of buoys 35, as seen in the prevailing weather direction W, and have a chosen mutual distance transversely to the weather direction. The buoys 44 in the second buoy pair are arranged for connection of a respective end of a pair of mooring hawsers or mooring lines 45 for mooring of the tanker 3, a first end of the mooring lines 45 being connected to a respective one of the buoys 44, whereas the other end is connected to the stem of the tanker. As shown, the mooring lines 45 comprise a chain portion 46 near the buoys 44.

The buoys 35 are surface buoys, as appears from FIG. 8, whereas the buoys 44 are submerged buoyancy buoys (so-called "spring" buoys). As shown in FIG. 9, the buoys divide the anchor lines 34 in an upper segment 47, a middle segment 48 and a lower segment 49.

In a manner corresponding to that of the first buoy pair, also the buoys 44 in the second buoy pair are attached to the anchor lines 44 of the platform 32, so that the tanker in moored condition is situated between these two anchor lines.

A supplementary supporting line 50 may be arranged between the buoys 44, in a similar manner as in the embodiment described before. The lower segment 49 of the anchoring lines 34 possibly may diverge additionally outwards in relation to the rest of the lines, as suggested with the angle $\alpha$ in FIG. 9.

In a corresponding manner as in the embodiment according to FIG. 5, it may be of interest to use separate anchors on the tanker as an additional mooring in connecting with the supporting line 50. Thus, in FIG. 9, a pair of stem anchors 51 are shown to be hooked to the supporting line 50.

The most important features of the mooring system according to the invention may be summarized as follows:

The collision barrier of the system will ensure that the tanker in case of accidents or fault operations does not touch the forwardly located production unit or floating unit.

The mooring system for the tanker may also be used as an integrated part of the anchoring system of the production unit or floating unit.

There are used only components according to well known technology.

The operational procedures for connection, loading and disconnection correspond to common maritime practice for corresponding operations.

The system will be able to be used both in connection with FPSO vessels and other fixedly anchored offshore production or floating units.

The system is very cost-efficient, especially at deep water.

What is claimed is:

1. A system for mooring a tanker near an offshore production unit (1) which is anchored by means of a number of anchor lines (2, 14) and associated anchors, and from which a tanker (3) in use of the system is supplied with oil via a transfer means (24–26; 29), the tanker (3) normally being moored behind the production unit (1), as seen in the prevailing weather direction (W), characterized in that it comprises a first and a second pair of bottom-anchored buoys (13 resp. 15) located before or behind the production unit (1), as seen in the prevailing weather direction (W), and at a chosen distance from the production unit (1), the buoys (13) of the first pair being located closer to the production unit (1) than the buoys (15) of the second pair, the distance between the two buoy pairs being greater than the length of the tankers (3) to be moored, and the buoys (13 resp. 15) of each pair having a chosen mutual distance transversely to said weather direction (W), the buoys (13, 15) being arranged for connection of respective mooring lines (11, 12) for mooring of a tanker (3) in the region between the buoys (13, 15) with the fore-and-aft direction essentially coinciding with said weather direction (W), and that it further comprises a collision barrier (22) extending between the buoys (13) of the first buoy pair and being connected thereto, to prevent a collision between the tanker (3) and the production unit (1).

2. A system according to claim 1, characterized in that said mooring lines comprise a pair of mooring lines (11) for mooring one end of the tanker (3) to the first buoy pair (13), and a pair of mooring lines (12) for mooring the other end of the tanker to the other buoy pair (15).

3. A system according to claim 2, characterized in that the buoys (13) of the first buoy pair are fixed to a respective one of a pair of the anchor lines (14) of the production unit (1) diverging in a direction away from the production unit (1), and that the buoys (15) of the second buoy pair are also fixed to a respective one of said anchor lines (14), so that a tanker (3) in moored condition is located in the region between the two anchor lines.

4. A system according to claim 1, characterized in that the transfer means comprises two independent hose systems for the supply of oil from the production unit (1) to the tanker (3), each system comprising a first (24) and a second (25) floating hose interconnected through a swivel (26) which is fixed to a respective one of the first buoys (13), the first hose (24) being permanently connected between the production unit (1) and said swivel (26), and the second hose (25) by means of the swivel (26) being able to be pivoted between a storage position in which it extends between the swivel (26) and the production unit (1), and an operative position in which it extends between the swivel (26) and the midship manifold (5) of a moored tanker (3).

5. A system for mooring a tanker near a floating unit (32) which is anchored by means or a number of anchor lines (33, 34) and associated anchors, and from which a tanker (3) in use of the system is supplied with oil via a transfer means (37), the tanker (3) being moored behind the floating unit (32), as seen in the prevailing weather direction (W), characterized in that it comprises a first pair of bottom-anchored buoys (35) located behind the floating unit (32), as seen in the prevailing weather direction (W), and at a chosen distance from the floating unit (32), the buoys (35) having a chosen mutual distance transversely to the weather direction (W) and being arranged for connection of a respective end of a pair of mooring lines (36) for mooring of a tanker (3) by connecting the other ends of the mooring lines (36) to the bow of the tanker (3), and that it further comprises a collision barrier (22) extending between the buoys (35) and being connected thereto, to prevent a collision between the tanker (3) and the floating unit (32).

6. A system according to claim 5, characterized in that it comprises a second pair of bottom-anchored buoys (44) which are located at a chosen distance behind the first pair of buoys (35), as seen in the prevailing weather direction (W), and have a chosen mutual distance transversely to the weather direction (W), the distance between the two buoy pairs (35 resp. 44) being greater than the length of the tankers (3) to be moored, the buoys (44) of the second buoy pair being arranged for connection of a respective end of a pair of mooring lines (45) for mooring of a tanker (3) by connecting the other ends of the mooring lines (45) to the stem of the tanker.

7. A system according to claim 6, characterized in that the buoys (35) of the first buoy pair are fixed to a respective one of a pair of the anchor lines (34) of the floating unit (32) diverging in a direction away from the floating unit (32), and that the buoys (44) of the second buoy pair are also fixed to a respective one of said anchor lines (34), so that a tanker (3) in moored condition is located between the two anchor lines.

8. A system according to one of claims 1–7, characterized in that the collision barrier (22) consists of a several interconnected, floating fenders (23) which are arranged at a sufficient hight to prevent the bow of the tanker (3) to pass over the barrier.

9. A system according to one of claims 1–7, characterized in that the buoys (13) of the first buoy pair are surface buoys.

10. A system according to one of claims 1–7, characterized in that the buoys (15) of the second buoy pair are submerged buoys.

11. A system according to claim 10, characterized in that it comprises a supporting line (21) extending between the submerged buoys (15) of the second buoy pair.

12. A system according to claim 11, characterized in that each of said anchor lines (14) behind the buoys (15) of the second buoy pair are directed outwards at an angle ($\alpha$) in relation to the direction of the anchor lines (14) between these buoys (15) and the production unit (1).

* * * * *